US012331472B2

(12) United States Patent
Teichrob et al.

(10) Patent No.: US 12,331,472 B2
(45) Date of Patent: Jun. 17, 2025

(54) PORTABLE BRIDGE

(71) Applicant: ACROSS BRIDGES LTD., Rosedale (CA)

(72) Inventors: Gary Wayne Teichrob, Rosedale (CA); Patrick Scott Mason, Cultus Lake (CA); Jacob Christiaan Klaassen, Chilliwack (CA); John Verdonk, Rosedale (CA); Russell Lee Janzen, Chilliwack (CA); Dennis Keith Ho, Abbotsford (CA)

(73) Assignee: ACROSS BRIDGES LTD., Rosedale (CA)

( * ) Notice: Subject to any disclaimer, the term of this patent is extended or adjusted under 35 U.S.C. 154(b) by 912 days.

(21) Appl. No.: 17/504,815

(22) Filed: Oct. 19, 2021

(65) Prior Publication Data

US 2023/0119877 A1 Apr. 20, 2023

(51) Int. Cl.
*E01D 15/133* (2006.01)

(52) U.S. Cl.
CPC ..... *E01D 15/133* (2013.01)

(58) Field of Classification Search
CPC ..... E01D 15/133
USPC ..... 14/2.4, 69.5–72.5
See application file for complete search history.

(56) References Cited

U.S. PATENT DOCUMENTS 2,336,622 A * 12/1943 Le Tourneau ..... E01D 15/133 14/77.1
2,367,291 A * 1/1945 Le Tourneau ..... E01D 15/133 14/2.4
3,768,108 A 10/1973 Wadsworth
4,262,381 A * 4/1981 Blink ..... E01D 15/22 14/27
4,962,556 A * 10/1990 Helmke ..... E01D 15/127 14/2.4
4,972,538 A * 11/1990 Parramore ..... E01D 15/127 14/2.4
5,590,433 A 1/1997 Fricke
6,421,863 B1 * 7/2002 Tiffany ..... E01D 19/005 14/2.4
8,973,195 B2 * 3/2015 Breault ..... E01D 4/00 14/2.4

(Continued)

FOREIGN PATENT DOCUMENTS

CA 2750775 C 2/2013
CA 2796153 A1 5/2014

OTHER PUBLICATIONS

TerraCross Portable Bridge Sterling Site Access Solutions (Website) www.sterlingsolutions.com/product/terracross/.

*Primary Examiner* — Raymond W Addie
(74) *Attorney, Agent, or Firm* — Meunier Carlin & Curfman LLC

(57) ABSTRACT

A portable bridge includes a first end segment and a second end segment spaced apart. The first end segment and the second end segment are placed on opposite sides of an obstacle to be spanned by the portable bridge. A spanning segment is coupled between the first end segment and the second end segment for spanning the obstacle. The first end segment, the second end segment, and the spanning segment each include a plurality of parallel beams distributed across a width of the portable bridge. The plurality of parallel beams are aligned along a length of the portable bridge and the plurality of parallel beams are fixed to a top plate and a bottom plate.

12 Claims, 15 Drawing Sheets

(56) References Cited

U.S. PATENT DOCUMENTS

| | | | | |
|---|---|---|---|---|
| 2014/0127739 | A1* | 5/2014 | Capelli | H10K 10/46 257/40 |
| 2023/0279623 | A1* | 9/2023 | St.Romain | E04G 27/00 14/2.4 |

* cited by examiner

PORTABLE BRIDGE

CROSS-REFERENCE TO RELATED APPLICATIONS

This is the first application filed for the present invention.

FIELD OF THE INVENTION

The present invention pertains to the field of bridges for crossing over an obstacle, and in particular to a portable bridge that may be easily installed and removed to cross over obstacles.

BACKGROUND

At many industrial and construction sites there are a variety of obstacles that must be crossed by vehicles or personnel. Common obstacles include raised or buried obstacles such as pipes or pipelines, and sunken or buried obstacles such as streams or ditches. Portable or temporary bridges may be placed over such obstacles on short notice and repositioned as needed. Portable bridges are typically manufactured in a modular fashion, stored elsewhere, and then transported to the site where they are to be installed.

Some portable bridges may be complicated to manufacture and include a large number of parts, that lead to increased costs and weight. Some portable bridges are constructed using common materials, such as steel plates and matting. Such bridges are typically difficult to move, less strong, less stable, and require significant time to construct.

Portable bridges are typically tested to support a maximum weight. However, the amount of weight that may be safely supported by a portable bridge may change depending on how it is installed and the amount of support the bridge has from the underlying ground. When installed at a site, it can be difficult to determine the actual maximum weight supported for a particular installation.

Therefore, there is a need for a portable bridge that obviates or mitigates one or more limitations of the prior art.

This background information is provided to reveal information believed by the applicant to be of possible relevance to the present invention. No admission is necessarily intended, nor should be construed, that any of the preceding information constitutes prior art against the present invention.

SUMMARY

An object of embodiments of the present invention is to provide a portable bridge that has a simple-to-manufacture design. Another object of embodiments of the present invention is to provide a portable bridge that has known load characteristics that depend on the length of the bridge that is supported on the ground on either side of obstacles. Portable bridges of a predefined width may be connected together to form wider bridges and one or more side railings may be added to improve safety. A wooden deck may be added that flexes under the weight of wheeled or tracked vehicles crossing the bridge. The wooden deck also provides improved traction and is a replaceable wear component to prolong the life of the bridge.

In accordance with embodiments of the present invention, there is provided a portable bridge including a first end segment and a second end segment spaced apart. The first end segment and the second end segment are to be placed on opposite sides of an obstacle to be spanned by the portable bridge. A spanning segment is coupled between the first end segment and the second end segment for spanning the obstacle. The first end segment, the second end segment, and the spanning segment each include a plurality of parallel beams distributed across a width of the portable bridge. The plurality of parallel beams are aligned along a length of the portable bridge (the length for example being defined along a line connecting the first end segment and the second end segment) and the plurality of parallel beams are fixed to a top plate and a bottom plate.

In a further embodiment, the top plate, the bottom plate, a first one of the parallel beams on one outermost edge of the portable bridge, and a second one of the parallel beams on another outermost edge of the portable bridge opposite said one outermost edge, collectively define a sealed interior. The sealed interior is devoid of lateral stabilizing elements connecting different ones of the parallel beams. Thus, for example, the bridge interior space can potentially include one or more parallel beams, but in various embodiments none of the parallel beams are connected to one another via lateral stabilizing elements located within this sealed interior space.

In a further embodiment, some or all of the plurality of parallel beams are I-beams or H-beams. These beams may be oriented so that a single element extends substantially vertically, and top and bottom flanges extend substantially horizontally.

In a further embodiment, an outer portion of the first end segment and an outer portion of the second end segment provide a varying load rating of the portable bridge. The load rating is proportional to a lesser of a length of the first end segment in contact with a first ground foundation and a length of the second end segment in contact with a second ground foundation. In other words, the load rating varies in proportion to the length of the portion of bridge, which is not in contact with ground, and equivalently (because the bridge has a fixed length) the load rating varies in proportion to the length of the portion of the bridge which is in contact with ground.

An embodiment further includes a marking on the first end segment or the second end segment indicating the (varying) load rating as a function of the length of the first end segment in contact with a first ground foundation or length of the second end segment in contact with the second ground foundation. The marking can include plural sub-markings or a continuum of markings.

An embodiment further includes connectors on a lengthwise side of the portable bridge, to allow for a second portable bridge to be connected to the portable bridge. The lengthwise side is a side extending between the two end segments. The connectors allow for relative vertical movement between the portable bridge and the second portable bridge while inhibiting horizontal movement between the portable bridge and the second portable bridge.

In further embodiments, the connectors include a T-shaped male portion and a female portion including an enveloping portion shaped to receive the T-shaped male portion.

In further embodiments, the T-shaped male portion is tapered on three ends and the enveloping portion is tapered to receive the T-shaped male portion therein.

An embodiment further includes a plurality of wood planks spanning the width of the portable bridge, and a plurality of clamps. The plurality of clamps flexibly secures the wood to a top surface of the top plate.

In further embodiments, one or more of the plurality of clamps includes a plurality of rounded teeth. Each of said one or more of the plurality of clamps make contact with the plurality of wood planks using the plurality of rounded teeth.

An embodiment further includes a removable railing secured to a side portion of the portable bridge.

An embodiment further includes side plates and end plates. The top plate, the bottom plate, the side plates, and the end plates form a sealed enclosure with the plurality of parallel beams enclosed therein.

In further embodiments, a distance between the top plate and the bottom plate is larger in a center portion of the portable bridge than the distance between the top plate and the bottom plate at end portions of the portable bridge.

Embodiments have been described above in conjunctions with aspects of the present invention upon which they can be implemented. Those skilled in the art will appreciate that embodiments may be implemented in conjunction with the aspect with which they are described but may also be implemented with other embodiments of that aspect. When embodiments are mutually exclusive, or are otherwise incompatible with each other, it will be apparent to those skilled in the art. Some embodiments may be described in relation to one aspect, but may also be applicable to other aspects, as will be apparent to those of skill in the art.

BRIEF DESCRIPTION OF THE FIGURES

Further features and advantages of the present invention will become apparent from the following detailed description, taken in combination with the appended drawings, in which.

It will be noted that throughout the appended drawings, like features are identified by like reference numerals.

DETAILED DESCRIPTION

Embodiments of the present invention relate to a portable bridge that has a simple to manufacture design, that has known load characteristics that depend on the length of the bridge that is supported on the ground on either side of obstacles, or a combination thereof. In some embodiments, portable bridges of given widths may be connected together to form wider bridges. Railing may be added to improve safety. A wooden deck may be added that flexes under the weight of wheeled or tracked vehicles crossing the bridge. The wooden deck also provides improved traction, and is a replaceable wear component to prolong the life of the bridge.

Figure 1A:
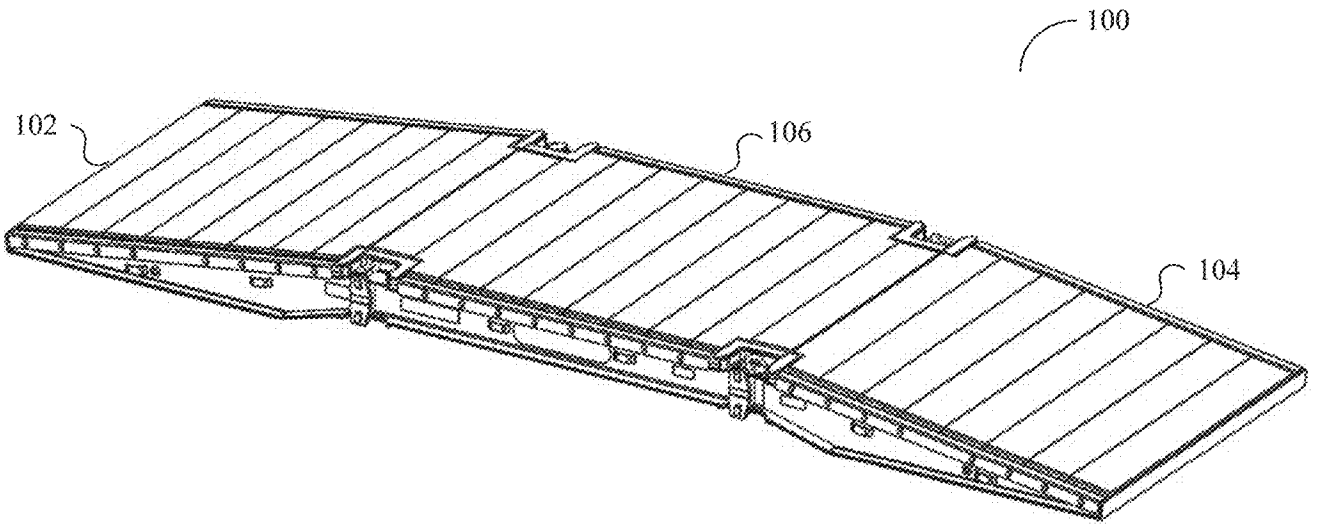
FIG. 1A illustrates a top perspective view of a portable bridge, according to an embodiment.
Figure 1B:
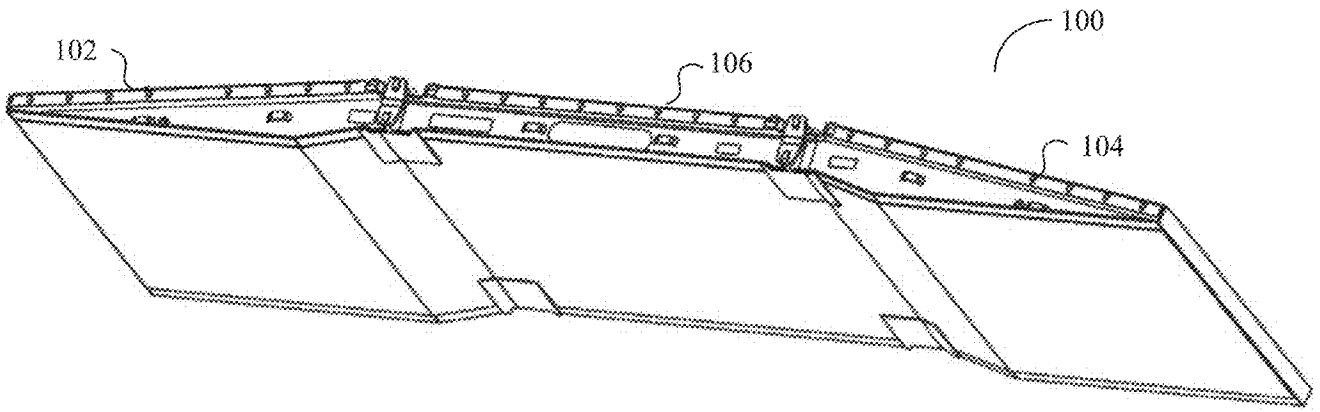
FIG. 1B illustrates a bottom perspective view of a portable bridge, according to an embodiment.

FIG. 1A and FIG. 1B illustrate a top perspective view of a portable bridge 100, according to an example embodiment. Portable bridge 100 includes three contiguous segments: a first end segment 102, a second end segment 104, and a spanning segment 106. End portions of the first end segment 102 and the second end segment 104 may be placed partially or fully on a foundation to support the portable bridge 100 over an obstacle. In embodiments, the foundation may be directly on the ground, or the foundation may be on a man-made structure such as gravel, concrete, pavement, blocks, etc. The first end segment 102, the second end segment 104, and the spanning segment 106 may all be constructed as a single unit. It is noted that in an alternative embodiment the segments 102, 104 and 106 may possibly be constructed from one or more physically separate units connected together. In an embodiment, each of the first end segment 102, the second end segment 104, and the spanning segment 106 may themselves be made of separate units. Some or all of the first end segment 102, the second end segment 104, and the spanning segment 106 may be constructed as modular units of a predetermined size. Some or all of the first end segment 102, the second end segment 104, and the spanning segment 106 may also be formed from multiple modular units of standard sizes. Some or all of the first end segment 102, the second end segment 104, and the spanning segment 106 may be straight without an arch and with a flat top, allowing the constructed portable bridge 100 to include only straight segments without any arch. As illustrated, the first end segment 102 and the second end segment 104 may be tapered towards outer ends of the portable bridge 100 that allows vehicles to more easily drive onto of off of the portable bridge 100. FIG. 1A illustrates how planking may be applied to a top surface of the bridge segments. FIG. 1B illustrates how a bottom portion of the bridge segments may be smooth to enable portable bridge 100 to sit flat on a foundation.

Figure 2A:
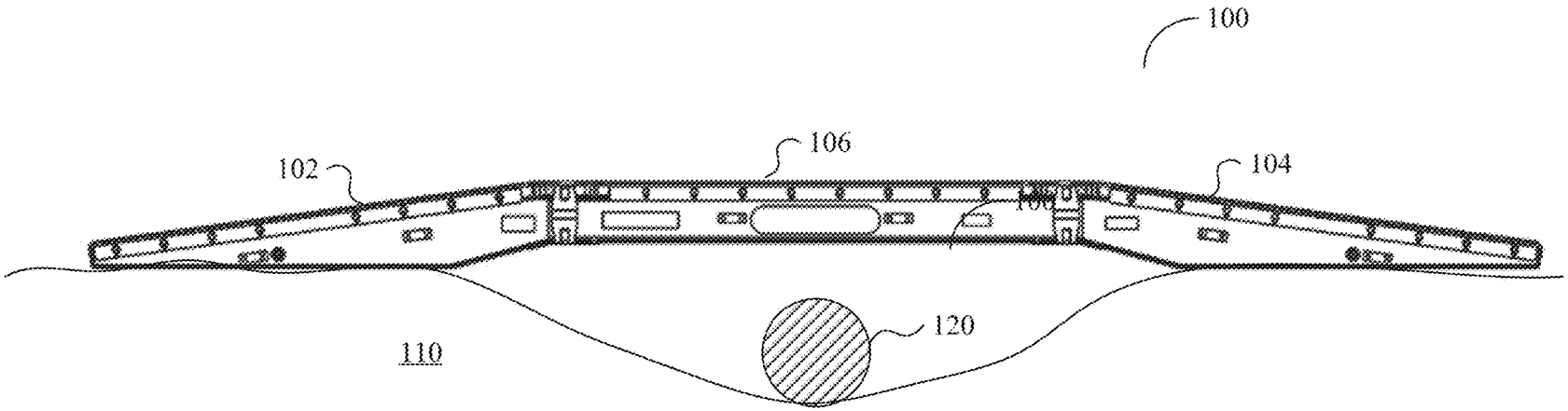
FIGS. 2A and 2B illustrate a side view of a portable bridge spanning an obstacle and a depression, according to an embodiment.
Figure 2B:
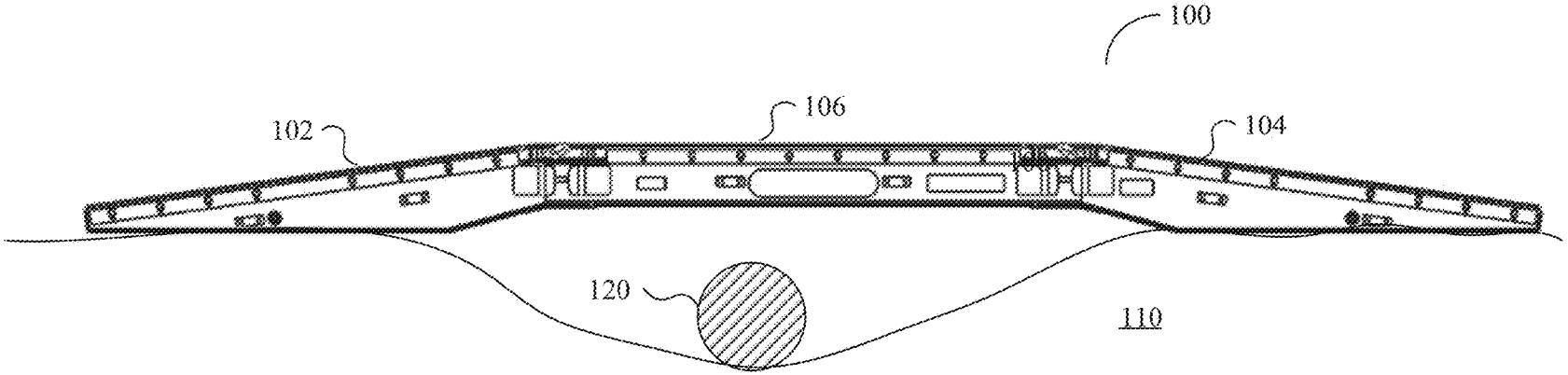

FIG. 2A and FIG. 2B illustrate side views of a portable bridge 100 spanning an obstacle and a depression, according to an embodiment. Foundation 110 may include a depression to be spanned which may include an obstacle 120 which may lie exposed in the depression or be buried under the center span of the portable bridge 100. In some embodiments the depression may be filled with material such as gravel or earth.

Figure 3:
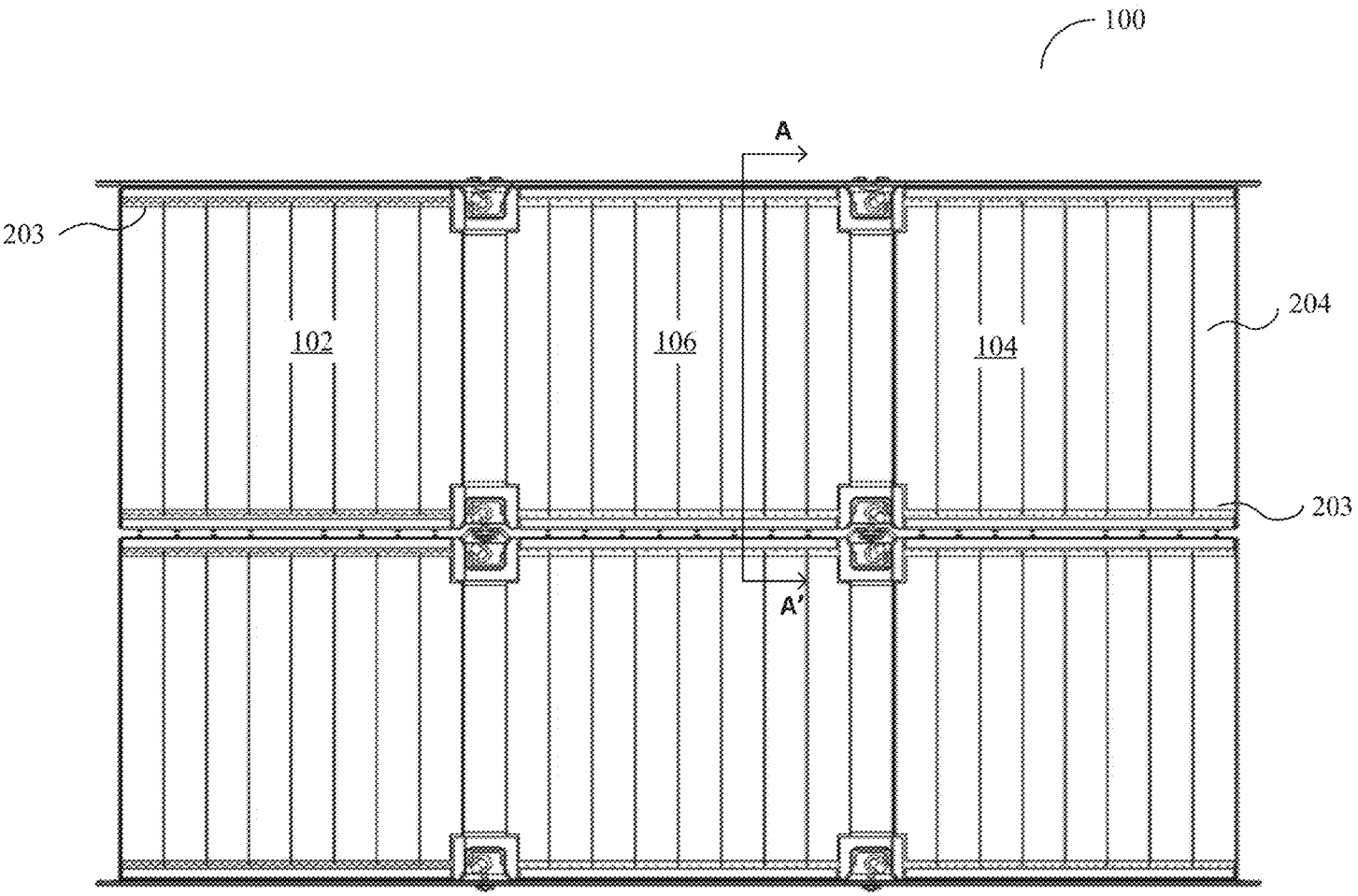
FIG. 3 illustrates a top view of two portable bridge connected together with planking installed, according to an embodiment.

FIG. 3 illustrates a top view of two portable bridges connected together, including planking 204 covering an upper surface of the bridges, according to an embodiment. Referring to portable bridge 100, the first end segment 102, the second end segment 104, and the spanning segment 106 are shown as they would be spanning an obstacle. A plurality of (e.g. wood) planks 204 may be installed across the width of any or all of the segments of portable bridge 100 to provide improved performance and traction when the portable bridge is used by tracked or wheeled vehicles. Parallel planks 204 may span the width of each of the segments secured to a top surface of a top plate of the portable bridge 100 by a plurality of clamps at location 203. Clamps flexibly secure planks 204 at both ends. Clamping allows planks 204 to partially float or move and partially flex under the weight of vehicles crossing the portable bridge 100. The use of clamps, rather than bolts or other fasteners, lessens the chance that a plank 204 may split, for example when heavy machinery is crossing the portable bridge 100. Clamps may be adjustable to compensate for shrinking, drying, or compression of wood planks 204 and varying dimensions among the plurality of planks 204. In embodiments, planks 204 may alternatively be made of plastic, or various composite materials exhibiting desired properties.

Figure 4A:
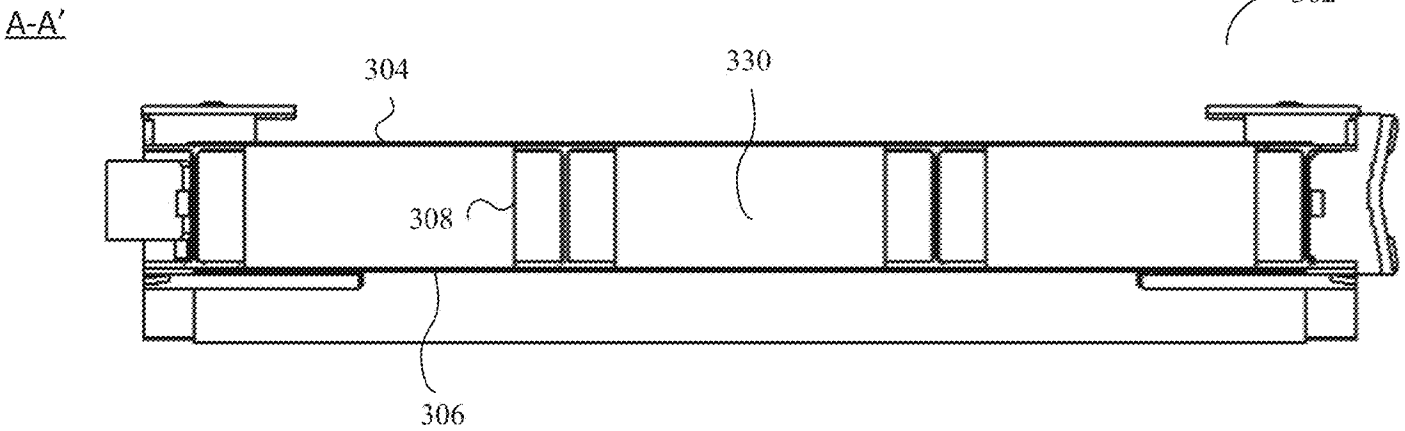
FIGS. 4A and 4B illustrate a cross section view of a portable bridge showing parallel beams distributed across a width of the portable bridge, according to an embodiment.
Figure 4B:
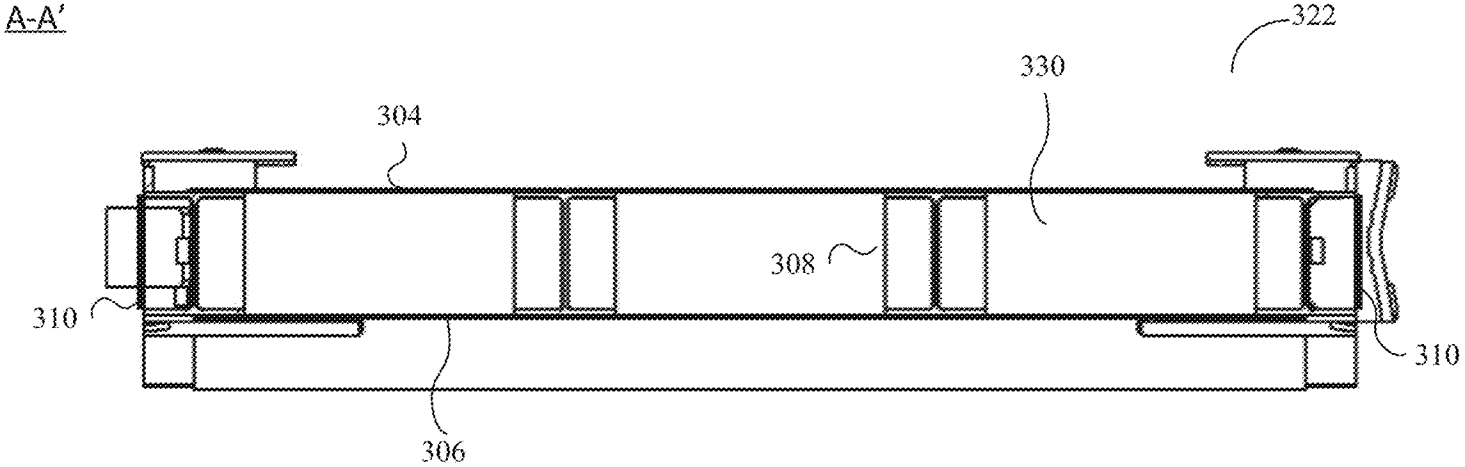

FIGS. 4A and 4B illustrate two cross section views 302 and 322 of a portable bridge, according to two alternative embodiments. The cross section of FIG. 4A or 4B corresponds to cross section at line A-A' of FIG. 3, though the cross section of FIG. 4A or 4B may also illustrate the construction of end segment 102 or end segment 104. The portable bridge 100 is characterized in having a plurality of beams 308 each extending along the length of the portable bridge 100 to provide strength and support. FIGS. 4A and 4B each show four beams 308, distributed in a spaced-apart manner across the width of the portable bridge, however more or fewer beams 308 may be used depending on the application, the required bridge load, the width and length of the bridge, the size and strength of each beam, and other structural or design factors. In embodiments, each beam 308 may be an I-beam an H-beam, or another similar structural element that includes horizontal flanges on the top and bottom joined by a vertical web (which may also be referred to as a "W-beam", with a wide flange, a "universal beam" (UB), a "rolled steel joist" (RSJ), a "double-T", or by other names as known in the art). A bridge may contain only I-beams, only H-beams, only W-beams, or a mixture of two or more types of beams in order to provide the required support given the length, width, and capacity of the portable bridge 100. In various embodiments, no lateral stabilizing elements are provided between adjacent beams 308. In other words, all interior spaces 330, defined by a pair of beams 308 and top plate 304 and bottom plate 306, may be devoid of rigid, physical elements which connect the pair of beams together. Instead, the top and bottom plates are the sole solid physical elements connecting beams together (ignoring any wooden planks over top of the top plate 304. For clarity, each pair of neighbouring beams defines sides of an interior space 330, while the two outermost beams also define sides of an overall interior space, which includes all the interior spaces 330 and the beams (if any) located between the two outermost beams. Because each interior space 330 is devoid of lateral stabilizing elements, the overall interior space is also devoid of lateral stabilizing elements. The entire assembly of beams 308, top plate 304, and bottom plate 306 forms a sealed interior around the exterior surfaces of the bridge (top, bottom, sides, and ends), to prevent the entry of liquids, dirt, mud, rocks, and other solids within any of the first end segment 102, the second end segment 104, and the spanning segment 106, thereby reducing required maintenance and extending the unusable life of portable bridge 100.

In embodiments, each beam 308 is fixed in place, for example by welding, bolting, or riveting, to a top plate 304 and a bottom plate 306. Optionally side plates 310 (FIG. 4B) may be fixed to each side as well. As the portable bridge is sealed around its perimeter, the top plate 304, the bottom plate 306, together with outermost ones of the beams 308 or side plates 310, form a sealed construction and collectively define a sealed interior. The sealed interior space is devoid of lateral (e.g., perpendicular or diagonal to the length of the bridge) stabilizing elements connecting different ones of the parallel beams 308. The sealed construction may inhibit rocks, mud, or debris from entering between the beams 308 making portable bridge 100 easy to clean and maintain and may extend the unusable life of portable bridge 100. The sealed construction also distributes weight across beams 308 and across the ground surface 104. The sealed construction may also, in some cases, provide buoyancy in wet or muddy conditions.

Figure 5A:
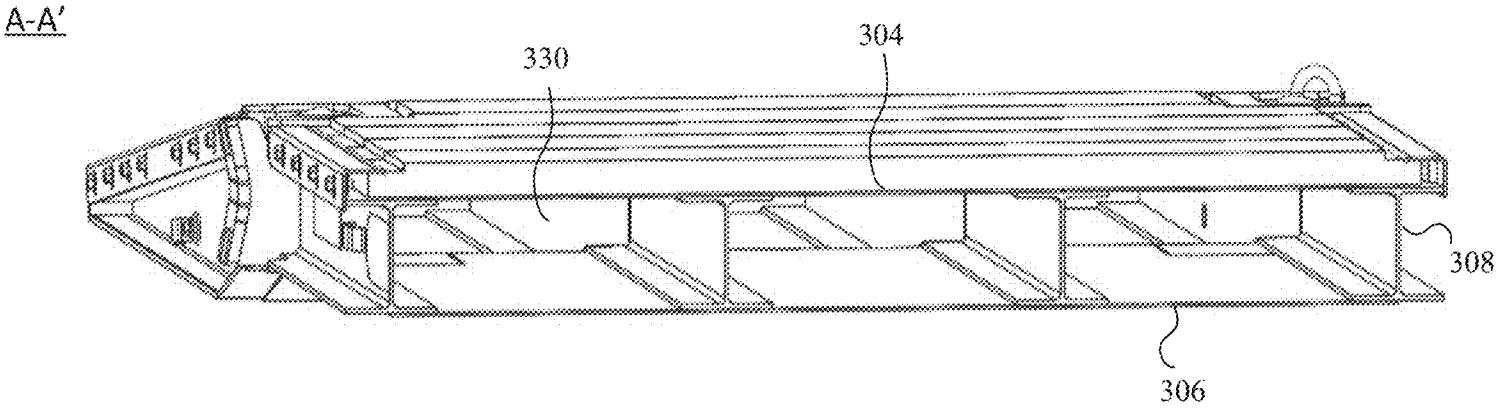
FIGS. 5A and 5B illustrate a perspective cross sectional view of a portable bridge showing parallel beams distributed across a width of the portable bridge, according to an embodiment.
Figure 5B:
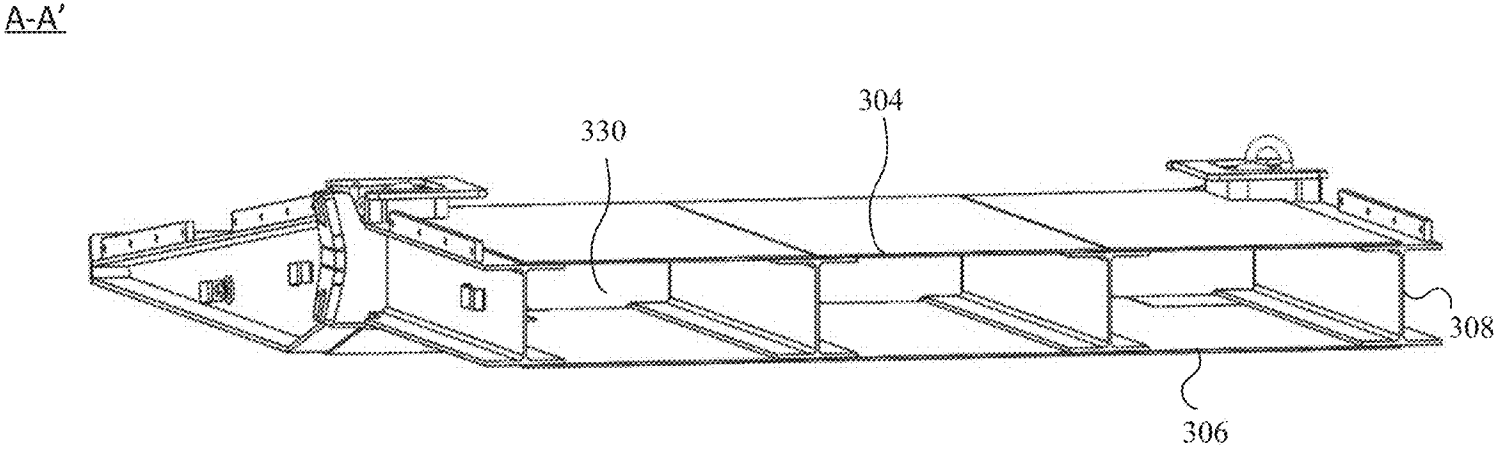

FIG. 5A and FIG. 5B, as already mentioned above, illustrates a perspective view of a portable bridge showing multiple parallel beams 308 distributed across a width of the portable bridge, according to an embodiment. FIG. 5A illustrates a portable bridge with planks fixed to top plate 304 while FIG. 5B illustrates a portable bridge without planks. In both FIG. 5A and in FIG. 5B, interior space 330 between beams 308, top plate 304 and bottom plate 306 may be observed.

Figure 6:
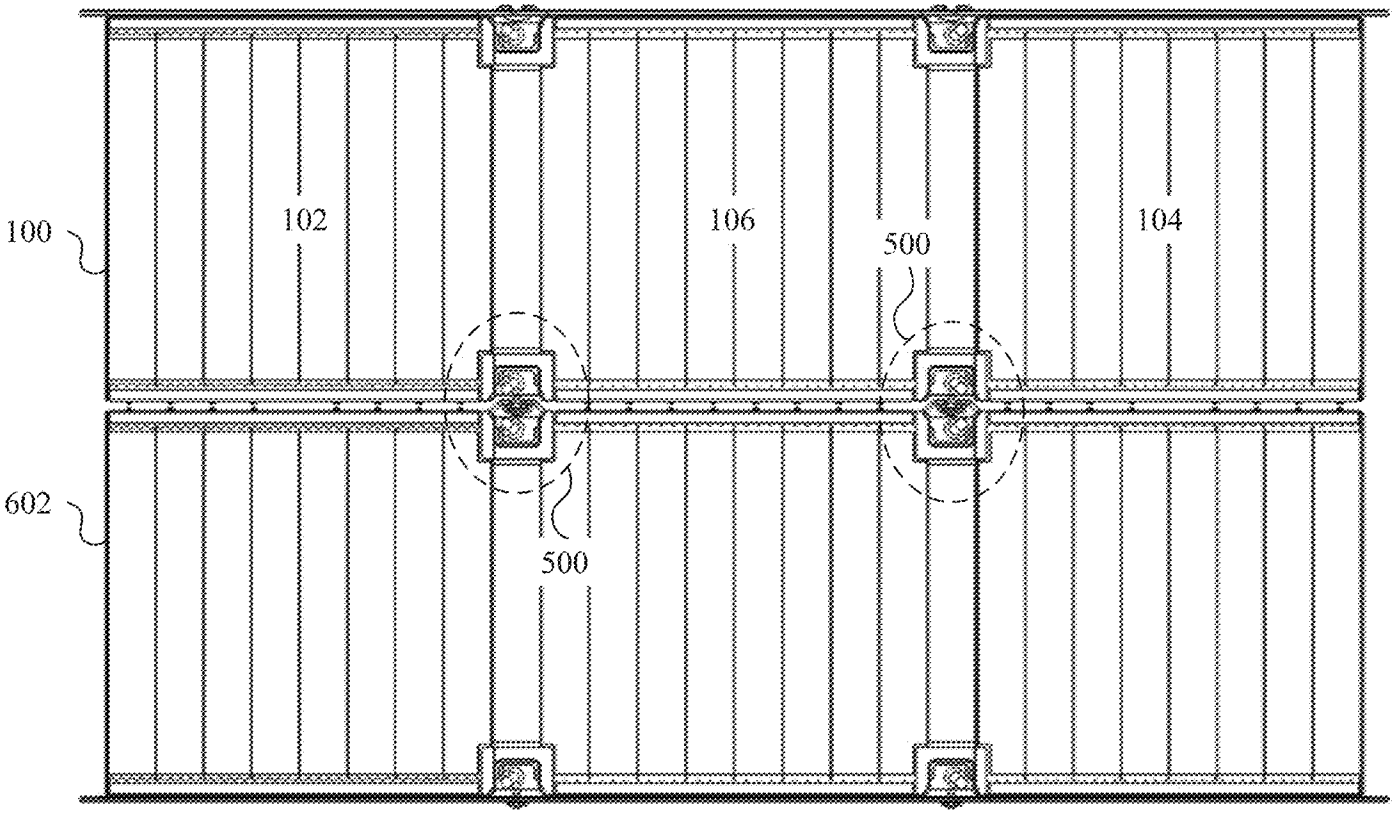
FIG. 6 illustrates an overhead view of multiple portable bridges linked together using the connectors, according to an embodiment.

In some embodiments, multiple portable bridges may be connected together to collectively provide for a wider overall bridge. FIG. 6 illustrates connectors 500 that may be used to connect a first portable bridge 100 to a second portable bridge 602, or to further portable bridges (not illustrated), according to an embodiment. Two, three or more portable bridges can be connected together in such a manner. Floating connectors 500 between portable bridges allows for a modular design and the quick expansion of the width of a portable bridge to an arbitrarily amount by adding additional portable bridges as needed as illustrated. The connectors 500 are placed at outer edges along the length of the portable bridge. Each connector may be a first type 502 (e.g., male) of connector or a second type 502 (e.g., female) of connector. The two types of connectors may be joined together to form a secure, double-tapered connection that allows for vertical (up/down) movement between bridges ("floating" in the vertical direction), but limits movement in the horizontal plane. Mating connectors can be placed so that, when two bridges are located adjacent one another, the connectors can be appropriately mated.

Figure 7:
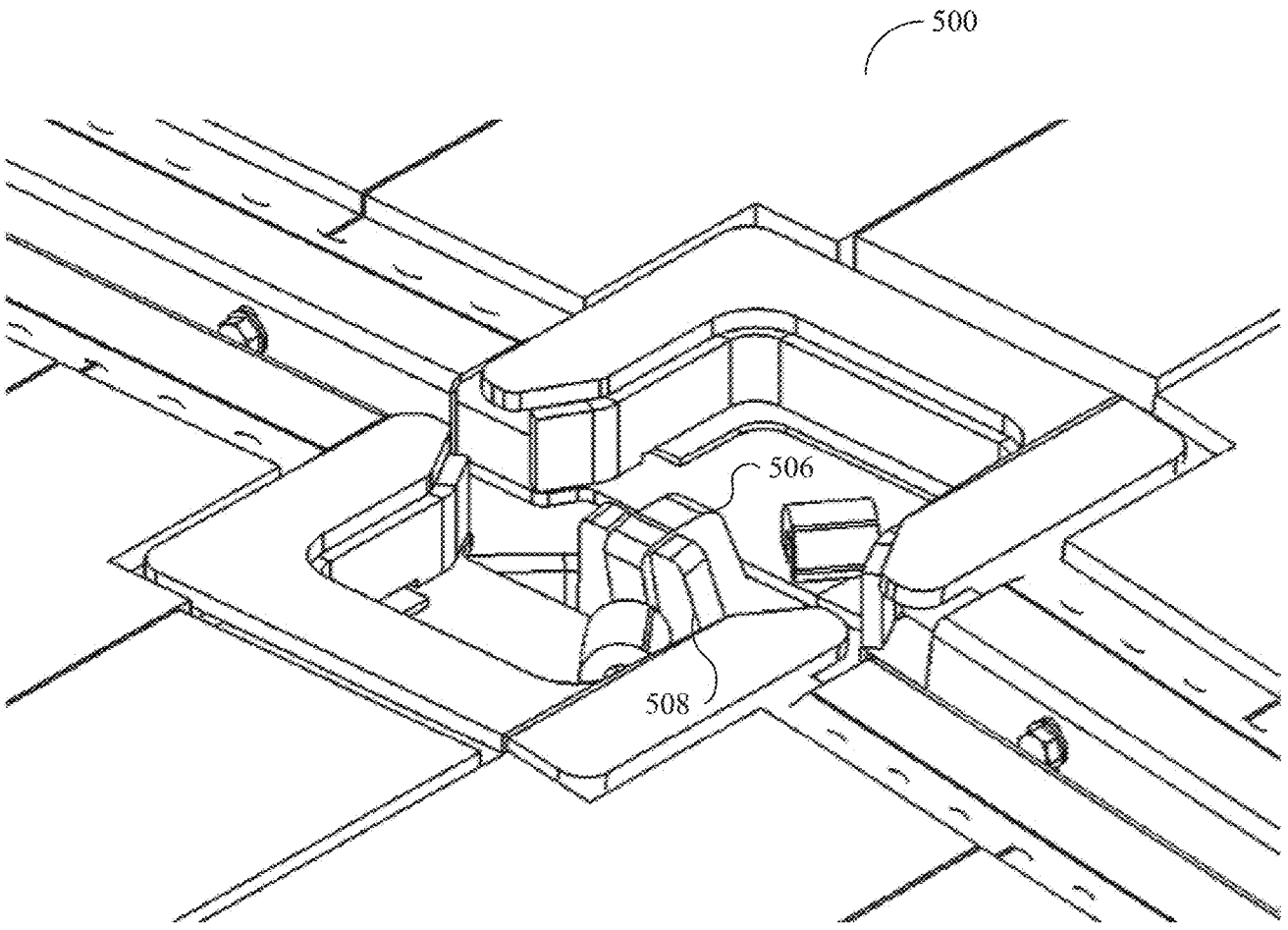
FIG. 7 illustrates connectors joining two portable bridges, according to an embodiment.

FIG. 7 illustrates a connector 500 joining two portable bridges, according to an embodiment. Further details of the connector 500 are described below with respect to FIGS. 8A-9B. A protruding straight portion 506 and cross portion 508, to be described below, are shown.

Figure 8A:
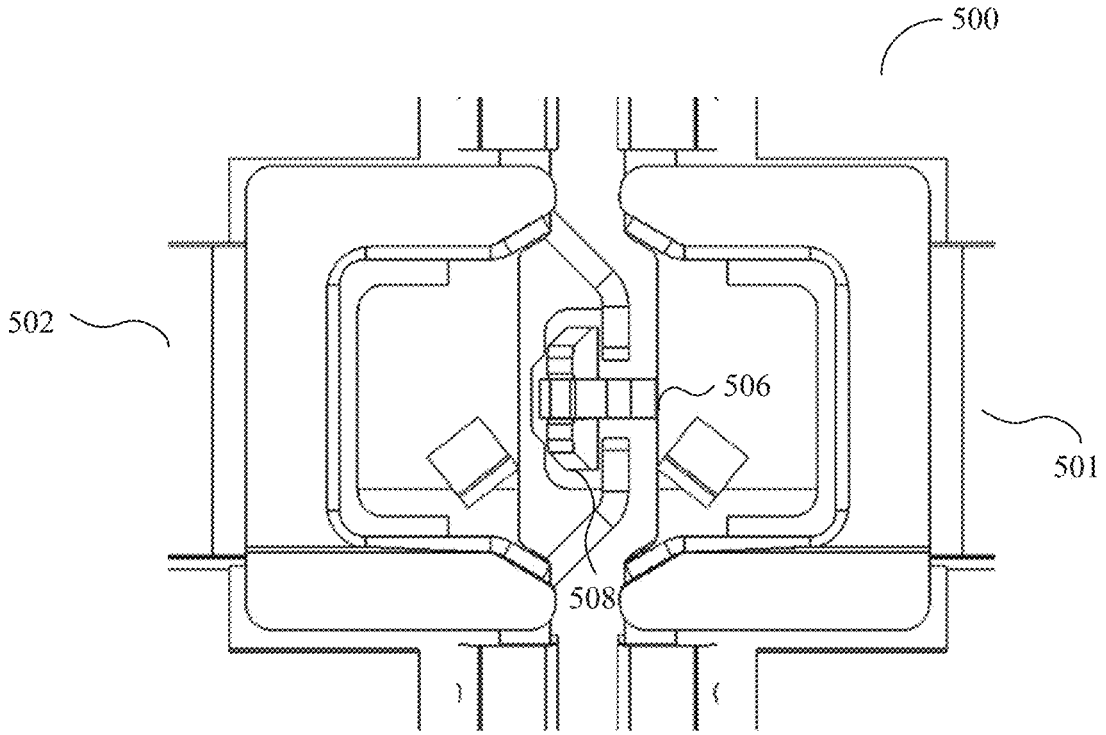
FIGS. 8A and 8B illustrate an overhead view and a cross sectional view of connectors joining two portable bridges, according to an embodiment.
Figure 8B:
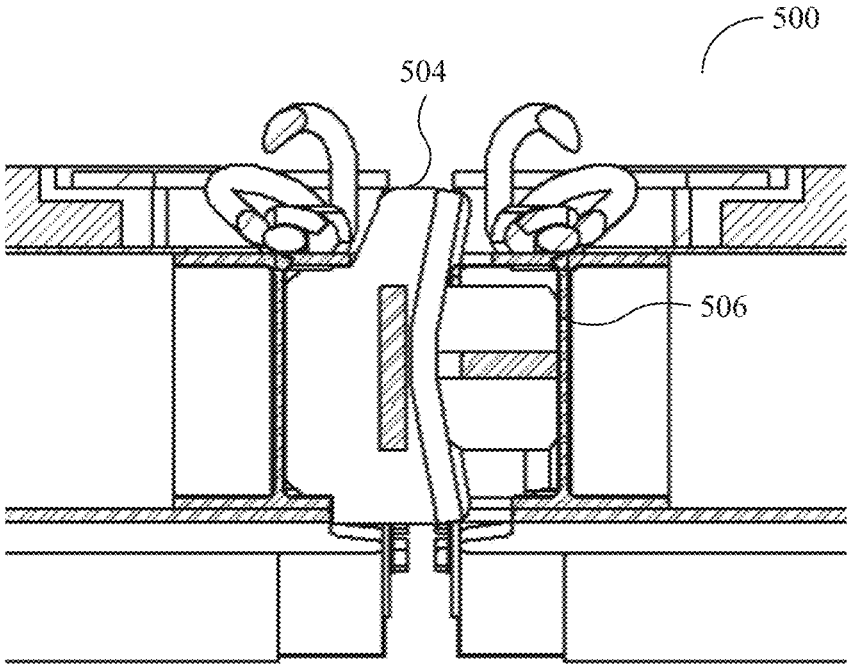

FIG. 8A illustrates an overhead view of connectors 500 joining two portable bridges, according to an embodiment. FIG. 8B illustrate a cross sectional view of the connectors joining the two portable bridges. The male portion 501 of the connector includes a T-shaped portion with a protruding straight portion 506 and a cross portion 508 that is perpendicular to the straight portion 506. The receiving, female portion 502 includes an enveloping portion that receives the T-shaped portion of the male connector to prevent movement of the joined portable bridges. Connectors 500 are formed to be floating where, when connected, the male portion 501 and the female portion 502 can move vertically while still being tightly coupled in the plane of the bridge 100. Connectors 500 may also have a double tapered design where the male, T-shaped connector 501 portion 506 and 508 is tapered on all three ends of the T, as well as tapered outwards to pull the bridges tight as they are coupled. The female, receiving connector 502 is also tapered to direct the T-connector into its slot.

Figure 9A:
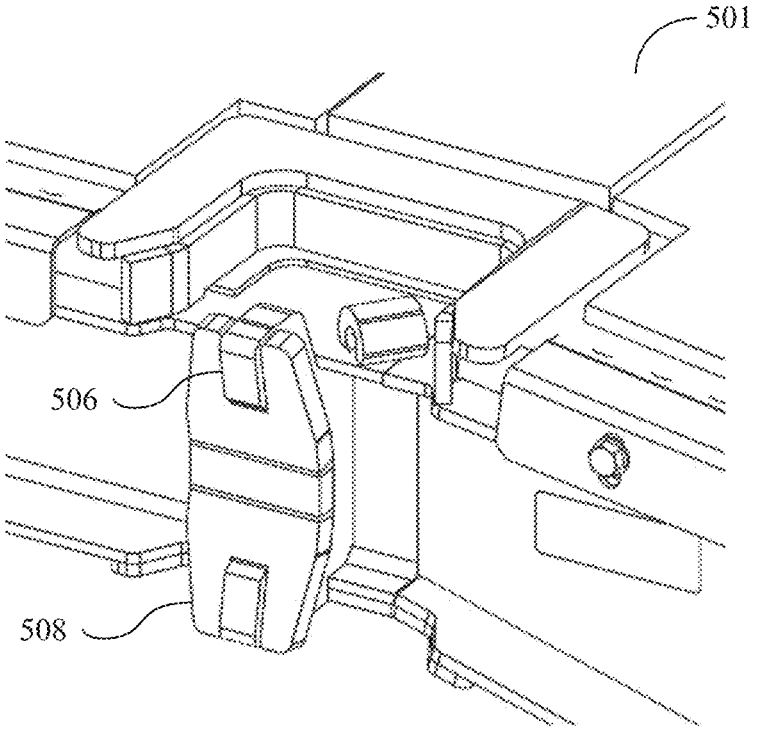
FIGS. 9A and 9B illustrate perspective views of the two connector portions, according to an embodiment.
Figure 9B:
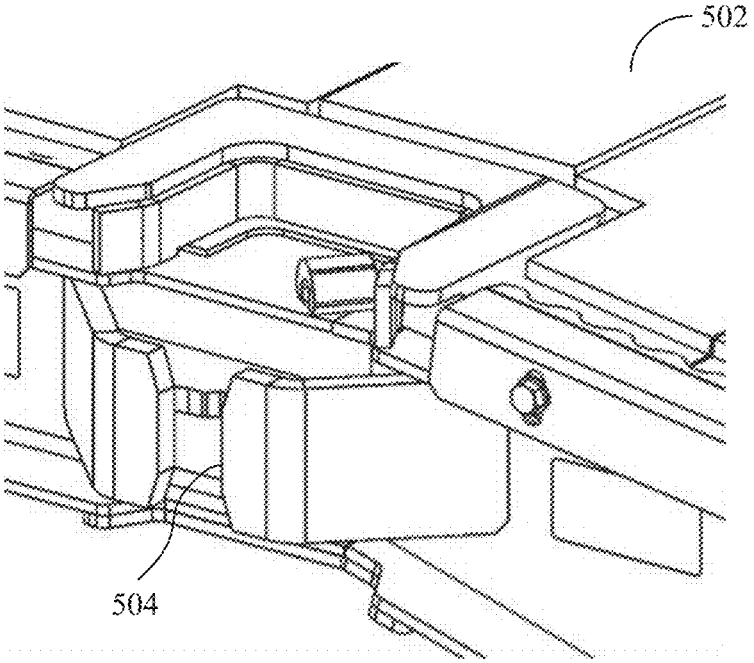

FIG. 9A provides a perspective view of the male connector portion 501 and FIG. 9B provides a perspective view of the female connector portion 502, according to an embodiment.

Figure 10:
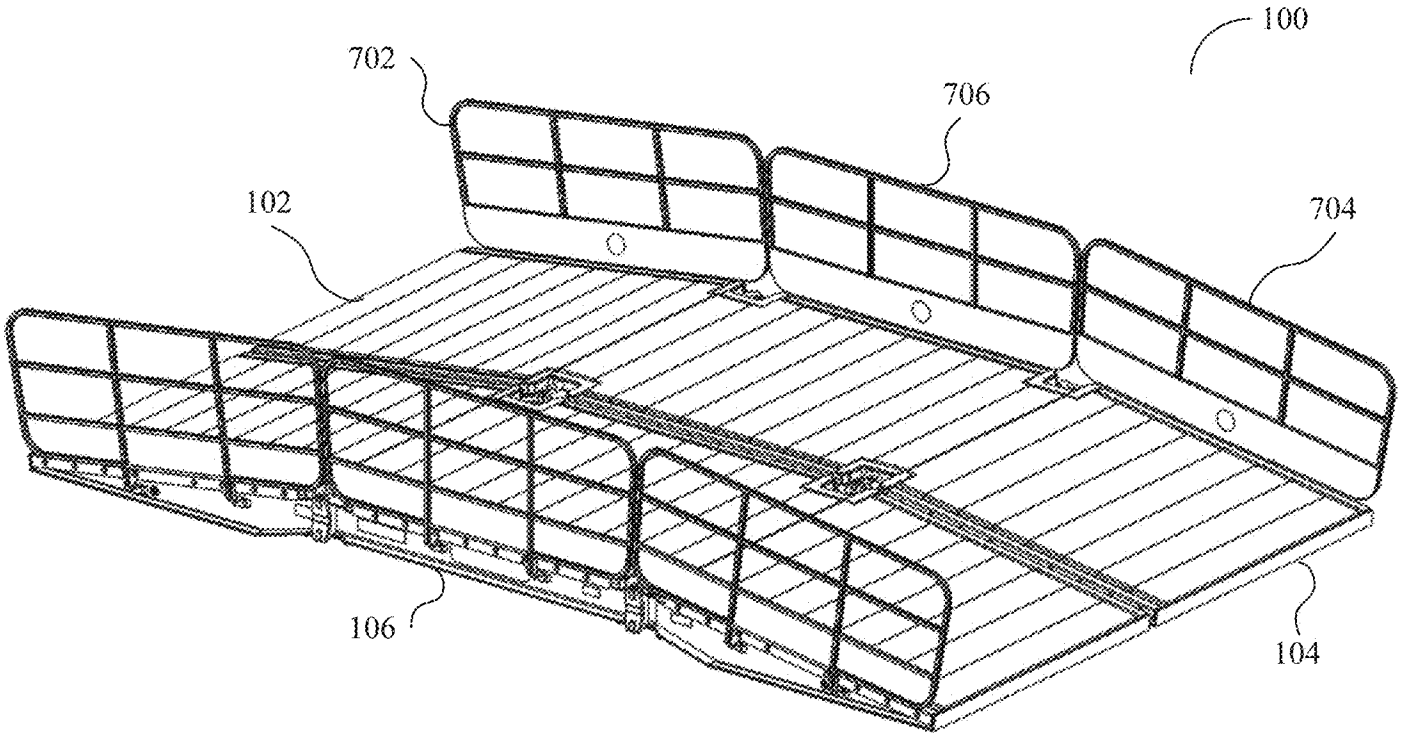
FIG. 10 illustrates removable railings secured to a side portion of a portable bridge, according to an embodiment.

FIG. 10 illustrates removable railings secured to a side portion of a portable bridge 100, according to an embodiment. Each segment of portable bridge 100 includes its corresponding segment of modular railing. Optionally, a single section of railing may be constructed and fitted to multiple segments of the portable bridge 100. In FIG. 10, end segment 102 includes railing 702, end segment 104 includes railing 704, and center segment 106 includes railing 706. In embodiments, railing 702, railing 704, and railing 706 may be identical, modular rail sections. In embodiments, each section of rail may clip into receptacles along the outside length of each segment of portable bridge 100 and may be installed and removed without the use of moving parts. In embodiments, rail segments may be rigidly retained in place using clamp bolts. When installed, rail segments may have some flexibility or springiness and are resistant to breaking if impacted by heavy equipment.

Figure 11A:
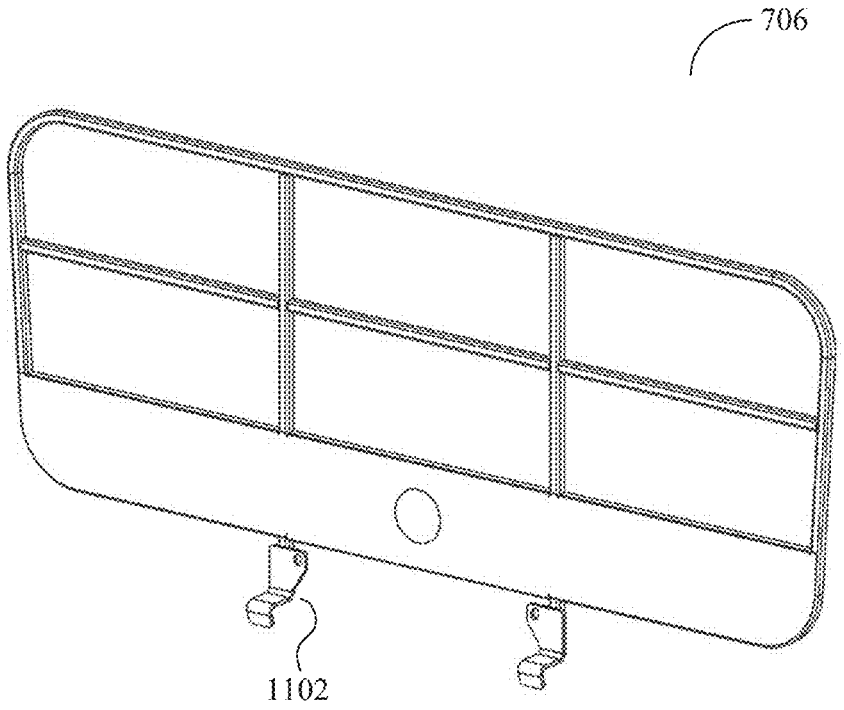
FIGS. 11A and 11B illustrate views of both sides of a railing segment, according to an embodiment.
Figure 11B:
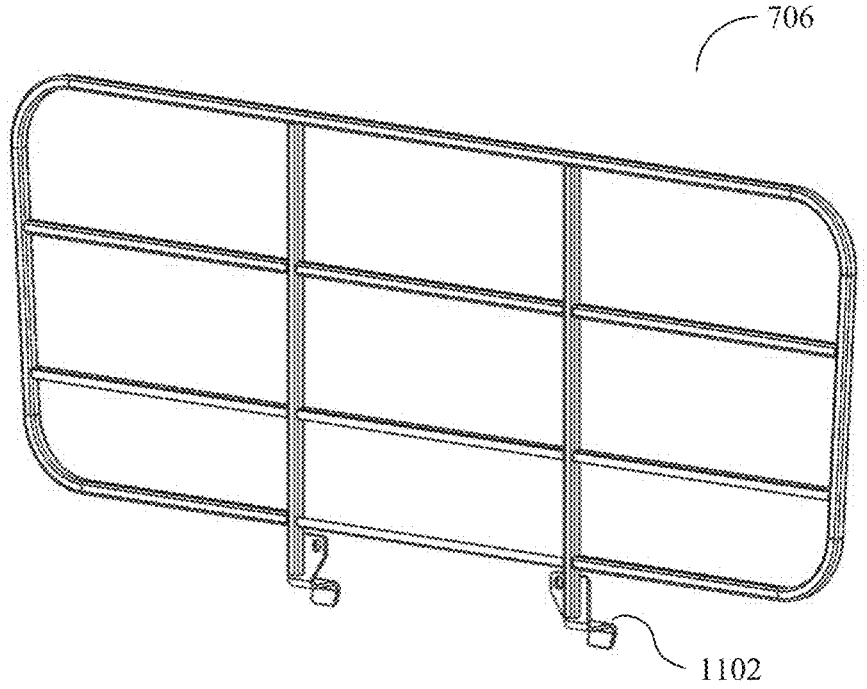

FIG. 11A and FIG. 11B illustrate views of both sides of a railing segment, according to an embodiment. Railing segment 706 is illustrated though it is understood that railing segments 702 and 704 may also have a similar construction. Mounting sections 1102 are fixed to a bottom portion of the railing segments to allow each railing segment to be installed and rigidly retained in place as illustrated in FIG. 12A and in FIG. 12B.

Figure 12A:
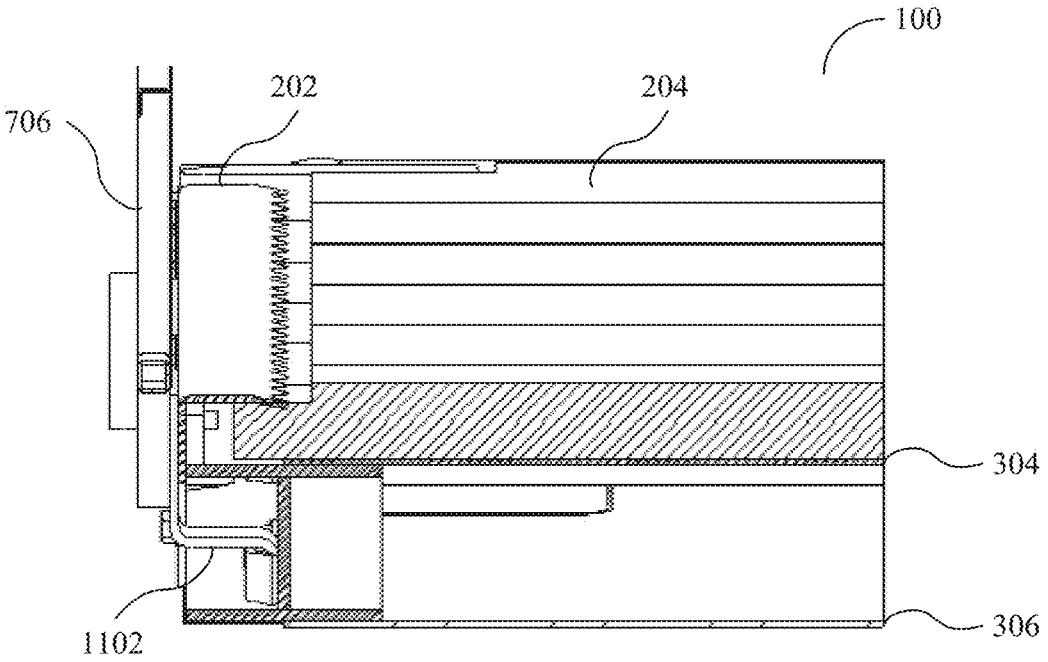
FIGS. 12A and 12B illustrate an end view and a cross sectional view of a portable bridge indicating how planks may be secured to the portable bridge using clamps, according to an embodiment.
Figure 12B:
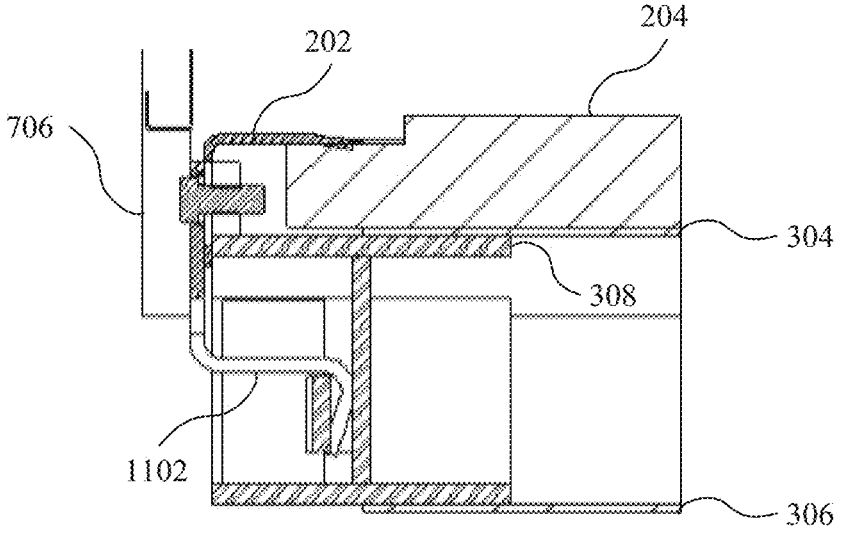

FIG. 12A and FIG. 12B illustrate an end view and a cross sectional view of a portable bridge indicating how a railing section 706 may be secured to segments of portable bridge 100, according to an embodiment. As illustrated, mounting sections 1102 may be secured beneath top plate 304 and against the vertical web sections of beams 308.

FIG. 12A and FIG. 12B also illustrate how planks may be secured to the portable bridge using clamps, according to an embodiment. Planks 204 may be secured to a top plate 304 of the portable bridge 100 using clamps 202. Clamps 202 include an edge pointing towards the center of the bridge surface with rounded teeth 802. Rounded teeth 802 may have a "scalloped" or a sine wave shaped edge and are formed at a slightly downwards angle to better to engage the wood planks 204. The clamps may be elongated with slotted holes, so that the clamps can rest on top of the wood planks 204 when clamped into place. In embodiments, approximately, 5 teeth engage each plank at each end. The clamps 202 may be adjustable to cause the rounded teeth and top plate 304 to grippingly engage, with a controllable amount of force, the planks 204 so that no additional clamping is required to secure the planks in place. The rounded teeth 802 of the clamps serve to reduce the risk of the clamps causing splits in the wooden planks.

Figure 13:
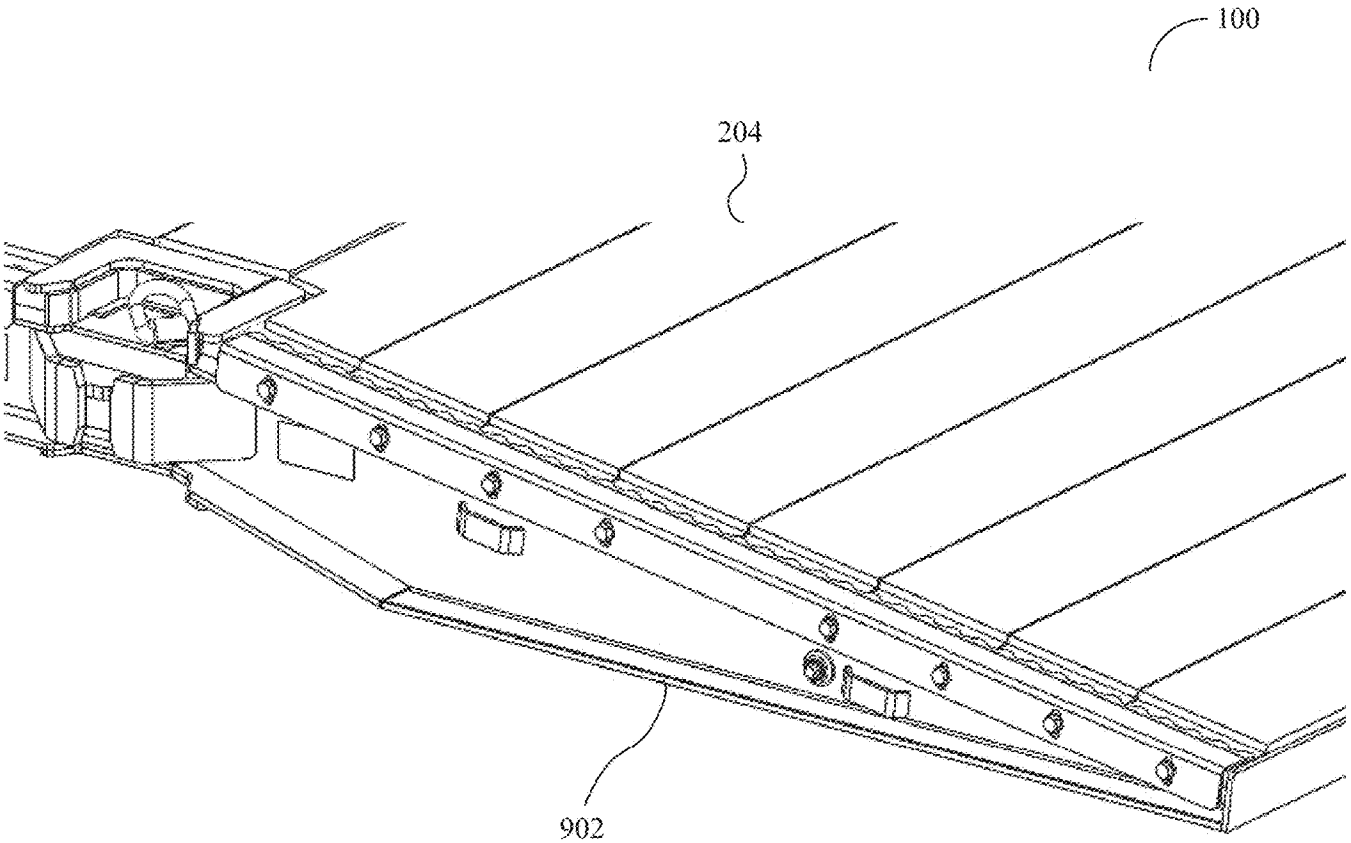
FIG. 13 illustrates a perspective view of end segments of a portable bridge showing indicators of a load capacity of the portable bridge, according to an embodiment.
Figure 14:
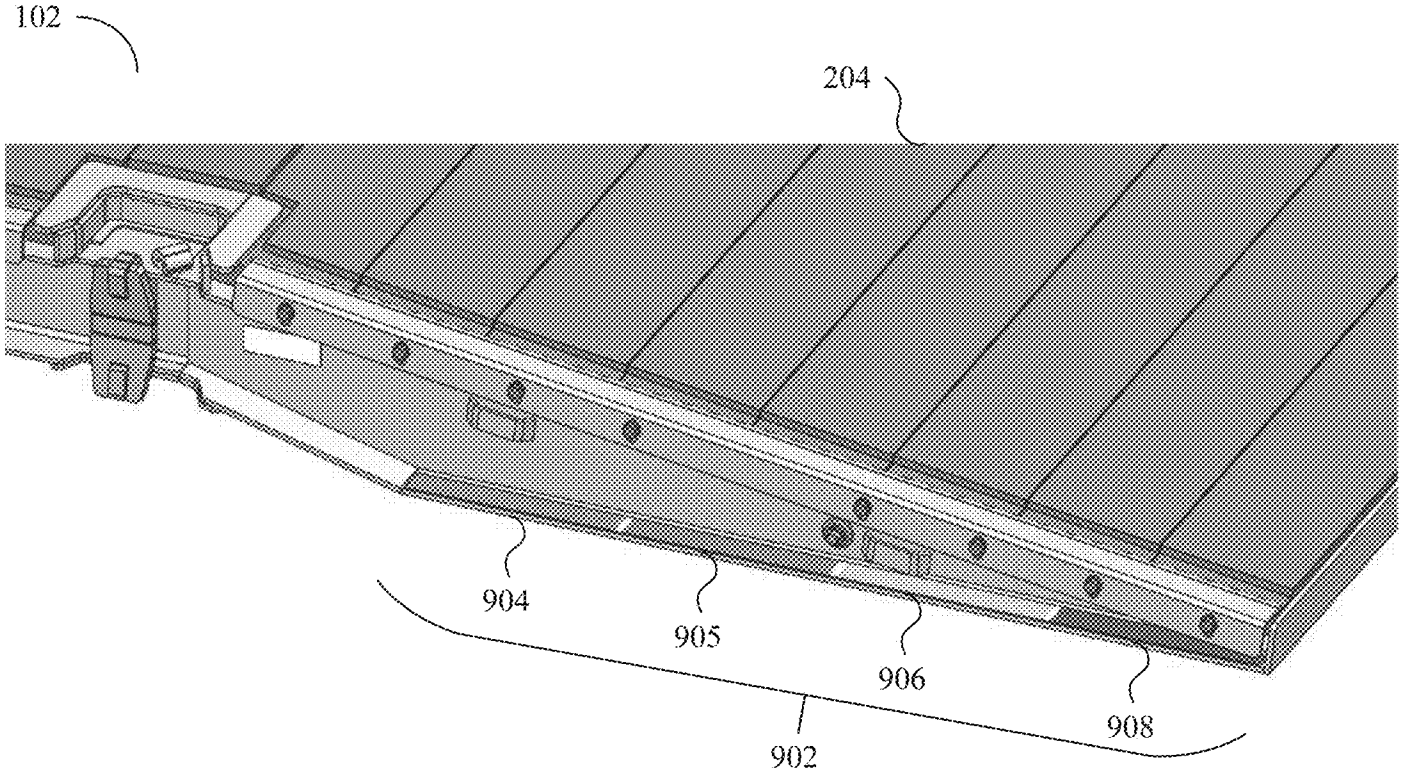
FIG. 14 illustrates the sections of load capacity indicators, according to an embodiment.

FIG. 13 illustrates a perspective view of end segments 102 or 104 of a portable bridge 100 showing indicators 902 of a load capacity of the portable bridge, according to an embodiment. The load bearing capacity of portable bridge 100 is proportional to the amount of a bottom surface of each end segment that is placed on and supported by a foundation. In an embodiment, the length of the foundation coverage of an outer portion of each end segment 102, 104 determines the load that portable bridge 100 can support. An indicator 902, which may take the form of a color-coded decal applied to each end segment 102 or 104, or to both end segments 102 and 104 provides a range of weight limits corresponding to the foundation coverage of the installed portable bridge 100. The placement of indicator 902 may be selected to allow for the simultaneous viewing of both the indicator 902 and the ground beneath the end segment which provides foundation coverage for the bridge. As shown in FIG. 14, indicator 902 may be divided into sections 904, 905, 906, and 908, that may be matched to the position of end segments 102 and 104 of portable bridge 100 on the ground to determine the load rating for the portable bridge. In embodiments, indicators 902 may be divided into more or less sections to indicate the load carrying capacity of portable bridge 100. An operator can inspect the indicator to obtain information about the current capacity of the bridge, depending on where the boundary between supported and unsupported portions of the bridge (the "boundary" hereinafter) is located relative to the indicator. In one embodiment, the indicator can be a single mark at an instant point along the bridge length. In this case, the operator can conclude that, when the boundary is between the indicator and the closest end of the bridge, the capacity is below a certain value, and when the indicator is between the boundary and the closest end of the bridge, the capacity is above a certain value. In another embodiment, the indicator can be a plurality of marks or a continuum of markings, with each mark being interpreted in a similar manner as described above and having its own related capacity. Markings can be ranges rather than points, with a range of markings potentially being associated with a same or similar capacity value, due for example to limitations on precision.

Figure 15:
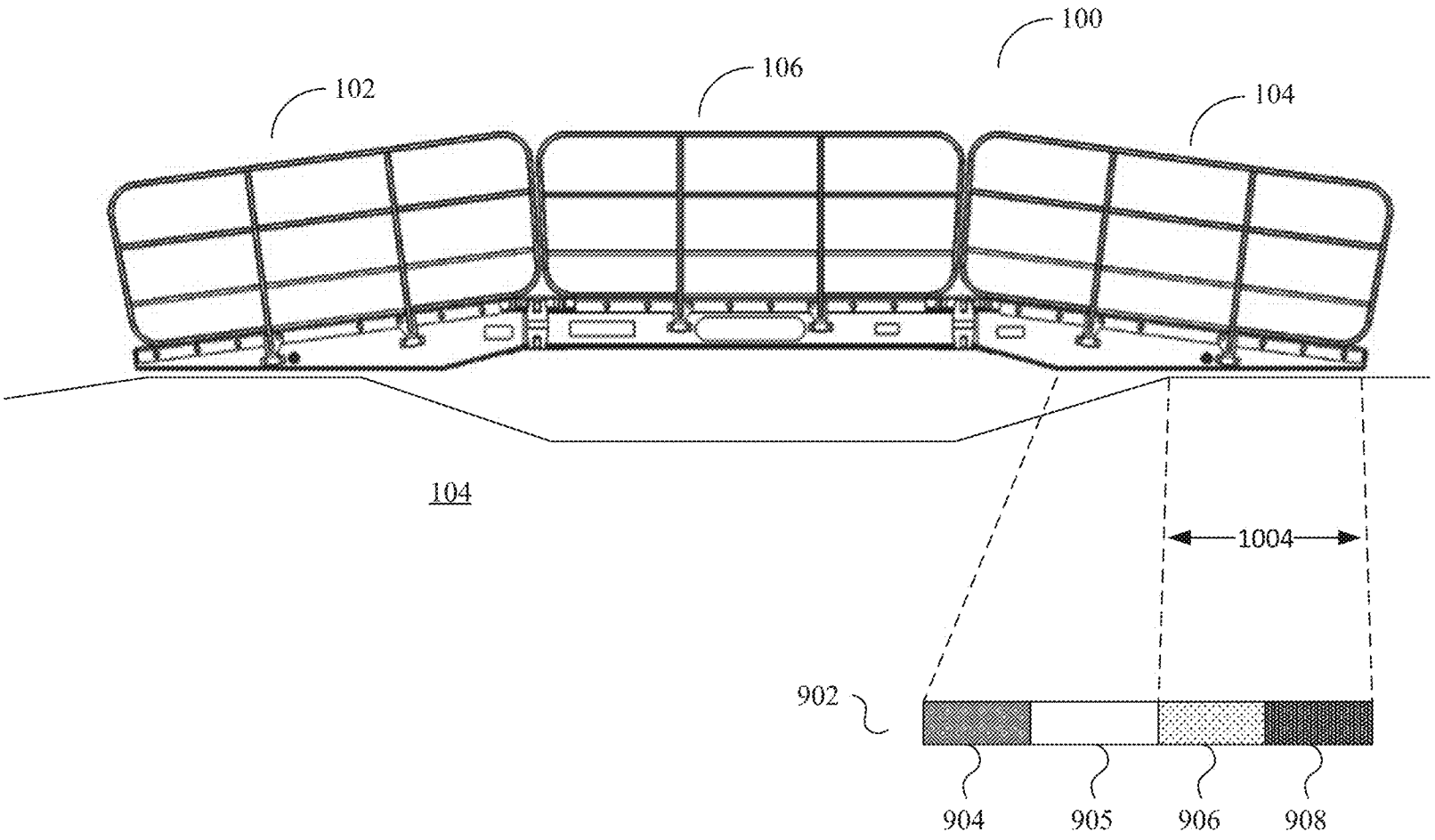
FIG. 15 illustrates how load capacity indicators may be used with a portable bridge installed, according to an embodiment.

FIG. 15 illustrates how the placement of a portable bridge 100 and load capacity indicators 902 may be used, according to an embodiment. In the FIG. 15, portable bridge 100 has been placed on ground 104 in a manner that end segment 104 is supported by a foundation coverage of length 1002. The innermost edge of length 1002, as applicable correspond to the above-described boundary. Length 1004 corresponds to indicator section 906 of load indicator 902 because the innermost edge of length 1004 is substantially co-located with part of the indicator section 906. Indicator section 904 indicates that portable bridge 100 may support approximately its full rated load. Indicator section 905 indicates that portable bridge 100 may support approximately ¾ (for example) of its rated load. Indicator section 906 indicates that portable bridge 100 may support approximately ½ of its rated load. Indicator section 908 indicates that portable bridge 100 may support approximately ¼ of its rated load. In embodiments, load indicator 902 may include any number of indicator sections such as 904, 905, 906 and 908 with may divide the load rating uniformly or in non-uniform portions. In cases where indicator 902 of end segment 102 indicates one load rating and indicator 902 of end segment 104 indicates another load rating, the lesser of the two indicated load ratings will be used as a weight limit for the portable bridge 100

Although the present invention has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations, or equivalents that fall within the scope of the present invention.

What is claimed is:

1. A portable bridge comprising:

a first end segment and a second end segment spaced apart, the first end segment and the second end segment for placing on opposite sides of an obstacle to be spanned by the portable bridge;

a spanning segment coupled between the first end segment and the second end segment for spanning the obstacle;

the first end segment, the second end segment, and the spanning segment each comprising a plurality of parallel beams distributed across a width of the portable bridge, the plurality of parallel beams aligned along a length of the portable bridge, the plurality of parallel beams fixed to a top plate and a bottom plate; and connectors on a lengthwise side of the portable bridge, the connectors allowing for a second portable bridge to be connected to the portable bridge, the connectors allowing vertical movement between the portable bridge and the second portable bridge while inhibiting horizontal movement between the portable bridge and the second portable bridge.

2. The portable bridge of claim 1 wherein the top plate, the bottom plate, a first one of the parallel beams on one outermost edge of the portable bridge, and a second one of the parallel beams on another outermost edge of the portable bridge opposite said one outermost edge, collectively define a sealed interior, the sealed interior being devoid of lateral stabilizing elements connecting different ones of the parallel beams.

3. The portable bridge of claim 1 wherein some or all of the plurality of parallel beams are I-beams or H-beams.

4. The portable bridge of claim 1 wherein an outer portion of the first end segment and an outer portion of the second end segment provide a varying load rating of the portable bridge, the load rating being proportional to a lesser of a length of the first end segment in contact with a first ground foundation and a length of the second end segment in contact with a second ground foundation.

5. The portable bridge of claim 4 further comprising a marking on the first end segment or the second end segment indicating the load rating as a function of the length of the first end segment in contact with a first ground foundation or length of the second end segment in contact with the second ground foundation.

6. The portable bridge of claim 1 wherein a distance between the top plate and the bottom plate is larger in a center portion of the portable bridge than the distance between the top plate and the bottom plate at end portions of the portable bridge.

7. The portable bridge of claim 1 wherein the connectors comprise a T-shaped male portion and a female portion including an enveloping portion shaped to receive the T-shaped male portion.

8. The portable bridge of claim 7 wherein the T-shaped male portion is tapered on three ends and the enveloping portion is tapered to receive the T-shaped male portion therein.

9. The portable bridge of claim 1 further comprising a plurality of wood planks spanning the width of the portable bridge, and a plurality of clamps, the plurality of clamps flexibly securing the wood to a top surface of the top plate.

10. The portable bridge of claim 9 wherein one or more of the plurality of clamps includes a plurality of rounded teeth, each of said one or more of the plurality of clamps making contact with the plurality of wood planks using the plurality of rounded teeth.

11. The portable bridge of claim 1 further comprising a removable railing secured to a side portion of the portable bridge.

12. The portable bridge of claim 1 further comprising side plates and end plates, wherein the top plate, the bottom plate, the side plates, and the end plates form a sealed enclosure with the plurality of parallel beams enclosed therein.

* * * * *